US005119932A

United States Patent [19]

Semanoff

[11] Patent Number: 5,119,932

[45] Date of Patent: Jun. 9, 1992

[54] MUSICAL BASE FOR DESK TOP ARTICLES

[75] Inventor: Ira Semanoff, Churchville, Pa.

[73] Assignee: Unified Printing & Promotions Corp., Ivland, Pa.

[21] Appl. No.: 629,829

[22] Filed: Dec. 19, 1990

[51] Int. Cl.[5] ..... A45C 11/34; B65D 85/28; G10F 1/12

[52] U.S. Cl. ..... 206/214; 206/320; 206/216; 84/95.2; 84/94.2

[58] Field of Search ..... 206/320, 576, 314, 214, 206/216, 223; 84/94.2, 94.1; 215/11.1

[56] References Cited

U.S. PATENT DOCUMENTS

| | | | |
|---|---|---|---|
| D. 135,847 | 6/1943 | Ajello | 84/94.2 |
| D. 171,436 | 2/1954 | Breen | D86/9 |
| 465,795 | 12/1891 | Sueur . | |
| 2,252,289 | 8/1941 | Kind et al. | 84/94.2 |
| 2,321,365 | 6/1943 | Darche | 84/94.2 |
| 3,170,359 | 2/1965 | Mourra | 84/94.2 |
| 3,627,161 | 12/1971 | Wergeland | 215/11.3 |
| 4,222,188 | 9/1980 | Tarrant et al. | 40/152.1 |
| 4,434,567 | 3/1984 | LeVeau | 40/157 |
| 4,678,093 | 7/1987 | Allen | 215/11.1 |
| 4,836,415 | 6/1989 | Grussmark | 206/216 X |
| 4,898,060 | 2/1990 | To | 215/11.1 X |
| 4,944,704 | 7/1990 | Grace | 215/11.1 |

FOREIGN PATENT DOCUMENTS

| | | | |
|---|---|---|---|
| 255887 | 5/1963 | Australia | 84/94.2 |
| 293516 | 12/1953 | Switzerland | 206/314 |

*Primary Examiner*—William I. Price
*Attorney, Agent, or Firm*—Eckert Seamans Cherin & Mellott

[57] ABSTRACT

Musical bases for desk top articles including bases for notepads, writing instrument holders and paper clip dispensers. Each base is provided with a sound producing module for emitting, for instance, music advertising jingles and speech. Operation of the module is provided by actuation of a switch or sensor built into the base. Actuation is accomplished in a number of ways including pressing on the base, sliding a drawer from the base or removing or replacing a writing instrument from the base.

18 Claims, 3 Drawing Sheets

FIG. 5.
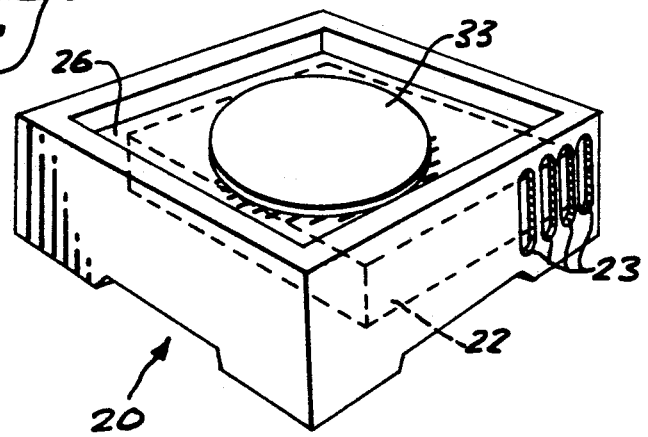
FIG. 6.
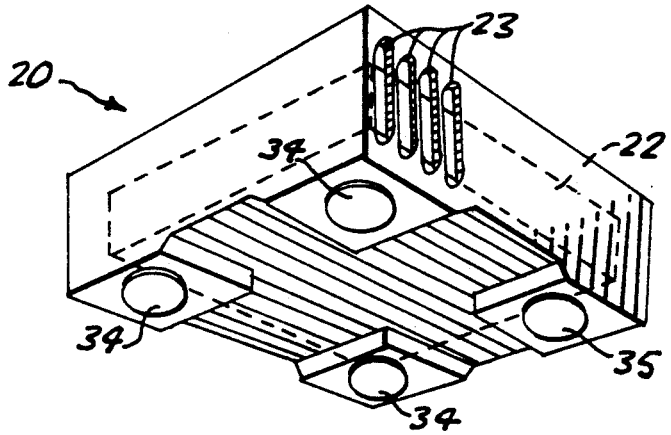
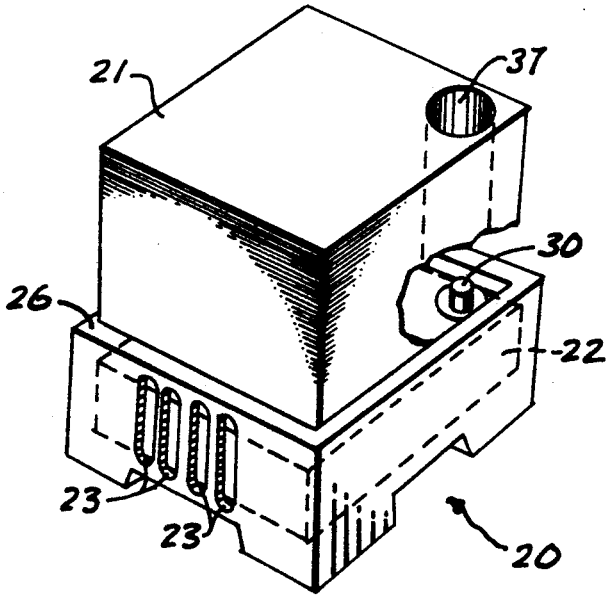
FIG. 7.

MUSICAL BASE FOR DESK TOP ARTICLES

BACKGROUND OF THE INVENTION

1. Field of the Invention

This invention relates to the field of desk top articles such as notepad holders and specifically to desk top articles having sound producing means incorporated therein.

2. Prior Art

Desk-top articles such as notepad holders and paper clip dispensers are generally functional items. The articles function by keeping important organizational items such as paper clips and note sheets immediately accessible for use. The invention provides additional features to these normally functional items by providing the items with means for producing sound or music when triggered by such use.

Certain functional articles having music boxes incorporated therein are known. U.S. Pat. No. 465,795 (Sueur) discloses a musical decanter comprised of a wind-up music module incorporated within the base of the decanter. The device has a feeler latch that drops to unblock a music box mechanism to play music when the decanter is lifted off a tabletop.

U.S. Pat. No. 2,252,289 (Kind et al.) discloses liquid pouring containers having wind-up music playing means. A tilt latch is provided such that inclination of the container when pouring the liquid retracts a stop blocking a music box mechanism.

U.S. Pat. No. 2,321,365 (Darche) discloses a musical picture frame. A rod depends downward from a wind-up music box associated, with the frame. When the frame is set on a flat surface, the rod moves into a position which blocks operation of the music box. When the frame is lifted, a spring retracts the rod from the mechanism, whereupon the music box plays.

U.S. Pat. No. 3,170,359 (Mourra) discloses a wind-up music box for telephones. A spring biased stop protrudes from the telephone cradle under the handset and releases the mechanism when the handset is lifted.

U S. Pat. No. 4,222,188 (Tarrant et al.) discloses a combination merchandise display case/sound reproduction device. The hinged cover of the case bears on a switch when the case is closed, and releases the switch to electrically trigger a sound producing means when the case is opened.

U.S. Pat. No. 4,434,567 (LeVeau) discloses a photo album or repository for keepsakes which includes an electrical music box. As in Tarrant, the music box is activated/deactivated by a pressure sensitive switch disposed under a hinged cover.

The present invention provides music or sound playing devices encompassed within functional desk top articles such as paper clip dispensers or notepad and pen holders. According to the invention, desk top articles that are functional and aid in work efficiency by organizing and dispensing note sheets, pens, paper clips and the like also produce music to improve the work atmosphere, provide an advertising jingle or otherwise to bring a note of cheer to the mundane articles which reside on desks and work surfaces. Whereas such articles normally do not have hinged covers or are not lifted from a surface when used, the invention provides a number of activation means that produce the necessary electrical signal for triggering.

SUMMARY OF THE INVENTION

It is a general object of the invention to provide desk top articles with sound producing features.

It is an object of the invention to provide a notepad holder with an incorporated music playing device that emits a cheerful or pointed musical program when the notepad is used.

It is an object of the invention to provide a combination notepad and pen holder having music playing means.

Another object of the invention is to provide a paper clip dispenser with music playing means incorporated therein.

A further object of the invention is to provide a notepad cube with a music playing module incorporated therein.

The above-listed objects are accomplished via a number of embodiments. The first embodiment includes a base arranged for receiving a notepad. The base can be constructed of any size consistent with the size of paper of the notepad. The base has an essentially flat top surface for receiving the notepad. A music or message playing device is preferably attached to the underside of the base in a concealed manner. The base preferably has structure adapted for holding a writing instrument therein. For instance, the structure could be a trough or depression in the base for holding a horizontally disposed instrument, or a vertically disposed support structure for holding a vertically disposed writing instrument.

It is further preferable to provide a switch for activating the sound producing device which communicates with the writing instrument holding structure. The communication with the writing instrument containment structure, for example, involves a lever arm or pressure sensitive plunger responsive to the presence or absence of the writing instrument in its holder. For example, a limit switch intersecting the writing instrument's path of insertion/removal, a weight sensitive switch or the like can trigger a tune upon removal and/or replacement of the writing instrument from the writing instrument holder. As a further feature, for example, a timing device is included to deactivate the sound producing device after a chosen period of activation.

A desirable modification to the above discussed embodiment includes, for example, the substitution of a photo detector for a mechanical activation switch as discussed above. Instead of removal or replacement of the writing instrument affecting a pressure sensitive plunger or lever associated with a switch, the removal or replacement varies the amount of light striking the photo detector. The change in state of the light intensity striking the photo detector is used in the known manner to provide a signal which according to the invention activate the sound producing device.

It is also possible to sense use of the notepad, writing instrument or other functional device in other ways. For example a magnet can be movably associated with an electromagnetic switch for producing a signal or contact closure. The magnet is either provided on the writing instrument or arranged to move in response to insertion/removal of the writing instrument. Changes in capacitance or inductance can also produce the signal, or with a conductive (metal) writing instrument, the signal can be produced by a change in continuity etc.

The sound producing device can reproduce generally pleasant music melodies or messages and advertising jingles specific to the user's company or organization.

In a related embodiment, the note pad containing base is provided with a drawer. The drawer can be used to hold small articles such as paper clips, spare leads, coins, tacks, keys, etc. A lever activated switch works in conjunction with the drawer to provide a signal activating the sound producing device upon sliding the drawer in or out. It is also possible to incorporate a photo detector switch into the drawer whereby, for example, when the drawer is at least partially opened, light strikes the photo detector switch and activates the sound producing device.

A preferred embodiment is adapted as a sound producing base for cubed pads of paper having advertising material printed on the cut edges of the pad. The stacked sheets provide a cube of paper with advertising messages on its sides. The base has a pressure sensitive switch built therein for activating the sound producing device. The cubed note pad has a hole extending from top to bottom through all the sheets. This hole is aligned with the pressure sensitive switch in the base. The hole functions as a vertically aligned writing instrument holder which positions the writing instrument over the switch. Removal or replacement of the writing instrument from the holder activates the pressure sensitive switch to trigger operation of the sound producing device. In this embodiment it is particularly advantageous to provide a sound producing device which plays advertising jingles consistent with the advertising material printed on the sides of the cube.

In another embodiment, a musical container for dispensing paper clips is provided. In a preferred embodiment, the container is a cup-like receptacle for holding paper clips which is movable slightly relative to a base. The container preferably includes a magnet near its upper rim for holding paper clips in a readily accessible position. The base has a sound producing device built therein and defines a vertical shaft. A biasing device such as a spring preferably encircles the shaft and urges the container away from the base. A pressure or lever arm actuatable switch is integrated into the base for sensing relative movement of the cup-like receptacle relative to the base. Movement of the container against the spring bias as occurs, for example, when removing a paper clip, actuates the switch and thereby activates the sound producing device. As discussed above, it is advantageous to additionally provide a timing device to deactivate the sound producing device after a pre-determined time.

The above-listed preferred aspects are not intended as limiting. For instance, sound producing devices are possible which have plural tunes, e.g., both musical melodies and advertising jingles, which can be played in turn or when selected. The design of the base is subject to some variation and can take any form as long as a note pad and writing instrument can be contained thereon and the presence or absence of the writing instrument, or the variation in weight or pressure which occurs in use of the article, are sensed and used to trigger the sound means.

BRIEF DESCRIPTION OF THE DRAWINGS

FIG. 5 is a perspective view of an alternative embodiment for the base, wherein a large diameter pressure sensitive switch on the upper surface activates the sound producing device.

FIG. 6 is a bottom perspective view of the base having a pressure sensitive foot pad switch for activating the sound producing device.

FIG. 7 is a perspective view of the base and notepad combination wherein the note pad has a bore for holding a writing instrument and the base has a pressure sensitive switch responsive to the writing instrument, for activating the sound producing device.

DETAILED DESCRIPTION OF THE PREFERRED EMBODIMENTS

One embodiment of the invention concerns a musical desk top notepad including a base having an essentially flat upper surface for placing a notepad thereon, a writing instrument holding means associated with the base, a sound producing device and a switch to activate the sound producing device, the switch being responsive to the presence or absence of the writing instrument in the holding means.

Figure 1:
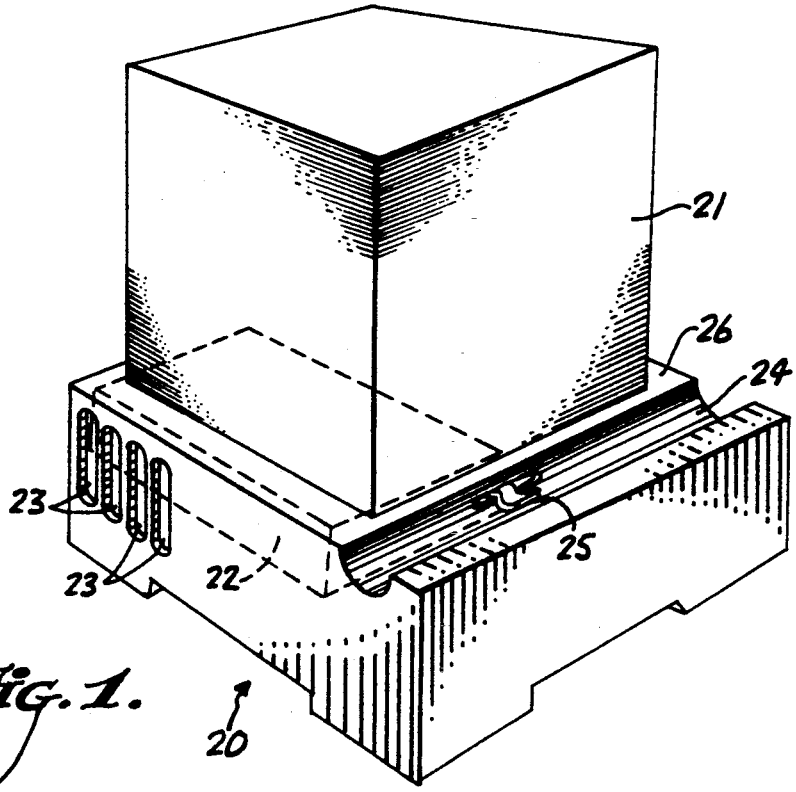
FIG. 1 is a perspective view of an article according to the invention, wherein the base has a trough for holding a writing instrument.

In FIG. 1, a perspective view of the base is shown. Base 20 can be essentially square or rectangular in plan and has an essentially flat upper surface 26 for supporting notepad 21 such that the top sheet is accessible to a user. Base 20 is constructed, for instance, of a relatively cheap durable and readily formable material such as plastic. Notepad 21 can be any small notepad of the type commonly found on work desks, but preferably is as a paper memo cube. Base 20 defines an enclosure housing a sound producing device 22. Sound producing device 22 is a module containing programmed or programmable components producing a desired sequence of sounds and/or messages. Electronic sound producing devices are well known and generally are powered by small hearing aid or watch type batteries. The sound produced can be, for instance, music, such as a popular song, an advertising jingle (which may include music and/or lyrics), or speech. The base preferably has port 23 which permits the produced sound to exit the base through appropriate openings.

Figure 2:
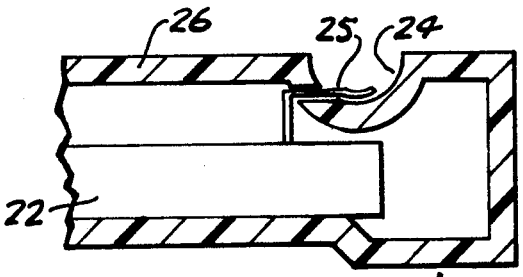
FIG. 2 is a section showing a lever switch disposed partly in the writing instrument holding trough, for activating the sound producing device as a function of the presence of the writing instrument.

The base 20 has a trough 24 for holding writing instruments such as a pen or pencil. Lever 25, which activates sound producing device 22, extends into trough 24, for example at the middle of the length of trough 24. Lever 25 is preferably spring biased upwardly to an e.g., horizontal position, allowing some downward displacement to achieve actuation of an electrical switch associated with the lever. A writing instrument (not shown in FIG. 1) resting in trough 24 will depress lever 25 and change the state of the switch. Lever 25 and the associated switch can act, when depressed, to activate or de-activate sound producing device 22. A timing mechanism can be incorporated within sound producing device 22 whereby sound producing device 22 is activated for a pre-determined time upon depression and/or release of lever 25. A section view showing lever 25 depending into trough 24 is illustrated by FIG. 2.

The sound producing device is preferably an integrated circuit processor programmed to read a stored tune or message in ROM and to play the same through a miniature speaker.

Figure 3:
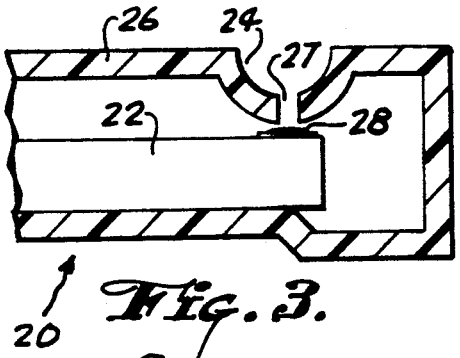
FIG. 3 is a section showing a photo detector for detecting the writing instrument in the trough, for activating the sound producing device.

FIG. 3 depicts an alternate method of activating sound producing device 22. The triggering means for sound producing device 22 has a photodetector pair, namely a light sensitive photodetector 28 and light source either arranged across the trough from the detector or positioned for reflection off the writing instrument. Light sensitive detector 28 is wired to or incorporated by sound producing device 22 to provide a contact closure or pulse triggering device 22. Therefore, activation of sound producing device 22 depends upon the intensity of light striking light sensitive detector 28, which in turn varies based upon presence or absence of the writing instrument.

Photodetector 28 can be, for example, a light sensitive photo transistor which conducts or saturates when the base region is exposed to light. An amplifier (not shown) can be included to make the photodetector sufficiently sensitive to respond to ambient light. Trough 24 has aperture 27 which is covered by the writing instrument. When a writing instrument is within trough 24, aperture 27 is blocked and the intensity of light incident on photodetector 28 is reduced. Removal of a writing instrument from the confines of trough 24 allows ambient light to strike photodetector 28 through aperture 27. Photodetector 28 thereby acts as an electronic switch to activate sound producing device 22 without mechanically engaging the writing instrument. Timing circuitry can be, for example, incorporated into base 20 or sound producing device 22 for activation of sound producing device 22 for a predetermined time upon removal or replacement of a writing instrument from trough 24. Replacement of the writing instrument into trough 24 blocks light from striking photodetector 28 thereby, for example, de-activating sound producing device 22. Alternately, removal of a writing instrument from trough 24 can de-activate, and replacement of the writing instrument activate, the sound producing device 22.

It is also possible to detect the writing instrument in other ways. A conductive instrument can be detected by a change in continuity between conductor contacts bearing inwardly at the trough, e.g., spring contacts. Changes in induction or capacitance can also be detected and used to trigger the output.

Figure 4:
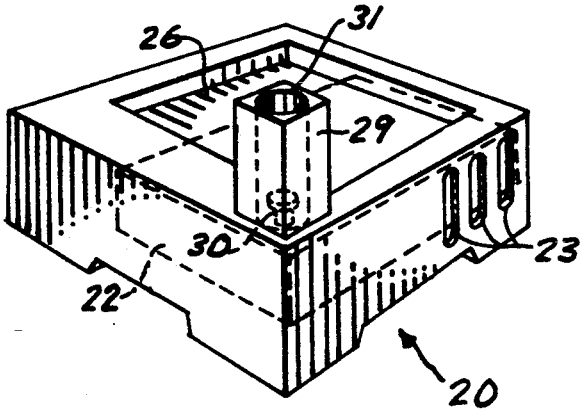
FIG. 4 is a perspective view of another embodiment, wherein the base has a vertical writing instrument holder with a pressure sensitive switch therein responsive to the writing instrument, for activating the sound producing device.

Now referencing FIG. 4, base 20 has sound producing device 22 incorporated therein. Upper surface 26 is shown as recessed for retaining a notepad or note cube (not shown in FIG. 4) in place. Base 20 has port 23 for transmitting sound produced by sound producing device 22 out of the enclosure thereof. Vertical holder 29 as shown has a vertically disposed cuboid form with a cylindrical longitudinally disposed opening 31. The opening is particularly adapted to contain and support a writing instrument. A pressure sensitive switch 30 resides at a lower section of cylindrical opening 31. A writing instrument within vertical holder 29 will depress pressure sensitive switch 30 to activate or de-activate sound producing device 22. Removal of the writing instrument from vertical holder 29 releases the pressure sensitive switch 30 to de-activate or activate sound producing device 22. Furthermore, a timing mechanism can be included whereby sound producing device 22 is activated for a pre-determined time upon removal and/or replacement of a writing instrument. Additional switches, such as an enable/disable switch, tune selection switch, etc., can be included so the user can select the mode of operation of the device.

In FIG. 5, base 20 has sound producing device 22 for reproducing music, voice or both. Port 23 allows sound to exit from within base 20. Sound producing device 22 is activated by disc 33, which is a large diameter pressure sensitive switch operable to detect weight or pressure on the base, for example due to a user writing on the pad or due to the presence or absence of a writing instrument. Disc 33 extends slightly above upper surface 26, for substantially supporting a notepad (not shown). Disc 33 is a pressure sensitive switch of sufficient stiffness whereby actuation will not occur under the weight of a notepad alone. However, by exerting additional force on the top of the notepad by, for example, pressing thereon to remove or write on a sheet, disc 33 will be depressed thereby activating sound producing device 22. After removal of the additional force, disc 33, induced by an internal bias such as a spring, returns to its undepressed position. As with the other preferred embodiments of the invention explained herein, a timing device can be incorporated into base 20 or sound producing device 22 for timed increments of device 22 activation upon depression of disc 33.

FIG. 6 shows a bottom perspective view of another embodiment of the invention. The bottom of base 20 has foot pads 34 and foot pad switch 35 defining the contact points of base 20 with, for example, a desk top. Foot pads 34 and foot pad switch 35 can be constructed of, for example, an aesthetically pleasing metal such as brass or hard rubber whereby non-marring, non-sliding contact points are provided. Foot pad switch 35 actuates when pressure is exerted on a notepad placed on the top surface (not shown in FIG. 6) of base 20. However, foot pad switch 35 is sufficiently stiff so that actuation does not occur under the weight of a notepad alone resting on base 20. Foot pad switch 35 returns to its original, undepressed state upon removal of the pressure on the notepad. Foot pad switch 35 has a relatively small actuation travel distance whereby base 20 will not be excessively tilted upon depression of the switch. Foot pad switch 35, upon actuation, activates or de-activates sound producing device 22.

The embodiment illustrated in FIG. 7 is similar in operation to that shown in FIG. 4. However, in FIG. 7, a writing instrument is held in the vertical position by a tube 37. The tube can be defined by a hole drilled or cut completely through notepad 21 itself. A writing instrument vertically disposed within tube 27 rests atop and depresses and actuates pressure sensitive switch 30. Removal of the writing instrument allows the switch, which is preferably biased upwards, to rise from its depressed position for activating or de-activating sound producing device 22. Alternate designs are within the scope of the invention whereby, for instance, placement of a writing instrument within tube 37 depresses pressure activated switch 30 and activates sound producing device 22. A timing mechanism can be incorporated whereby device 22 will emit sound for a pre-determined time upon depression and/or release of switch 30.

Figure 8:
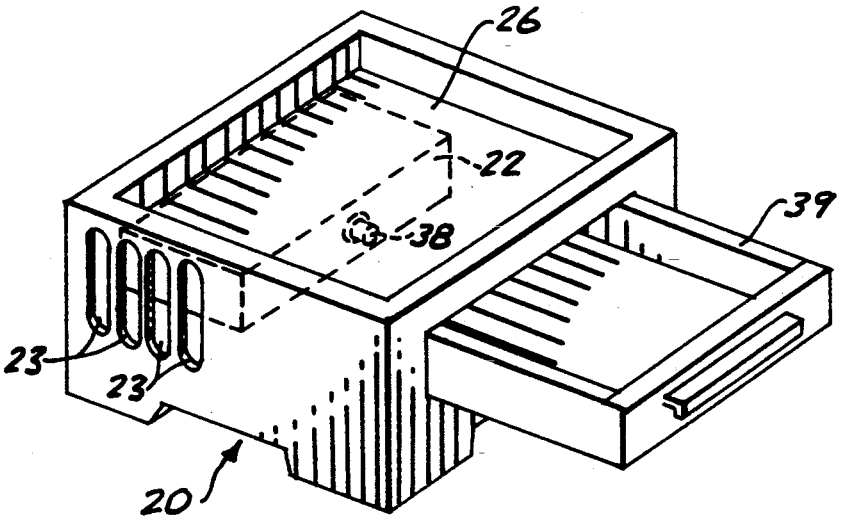
FIG. 8 is a perspective view of a base having an article holding drawer; sound producing device activation being dependent upon drawer position.

With reference to the alternative embodiment of FIG. 8, base 20 defines an enclosure for housing drawer 39 therein. Drawer 39 is slidably openable and can be used to store small office accessories such as, for example, paper clips, spare leads, erasers, keys, tacks etc. Sound producing device 22 has a plunger switch 38 responsive to the position of drawer 39. Plunger 38 fully extends in a non-depressed position when drawer 39 is substantially open. When drawer 39 is closed, the rear of drawer 39 depresses plunger 38. Sound producing device 22 can be designed to activate upon release or upon depression of plunger 38. Furthermore activation can occur upon either full or partial depression. Other modes of operation are within the scope of the invention such as activation upon full release of plunger 38 and de-activation upon full depression. Various other modes will be apparent to those in the art including the incorporation of a conductive detector or photodetector in, for example, the side of the drawer.

Figure 9:
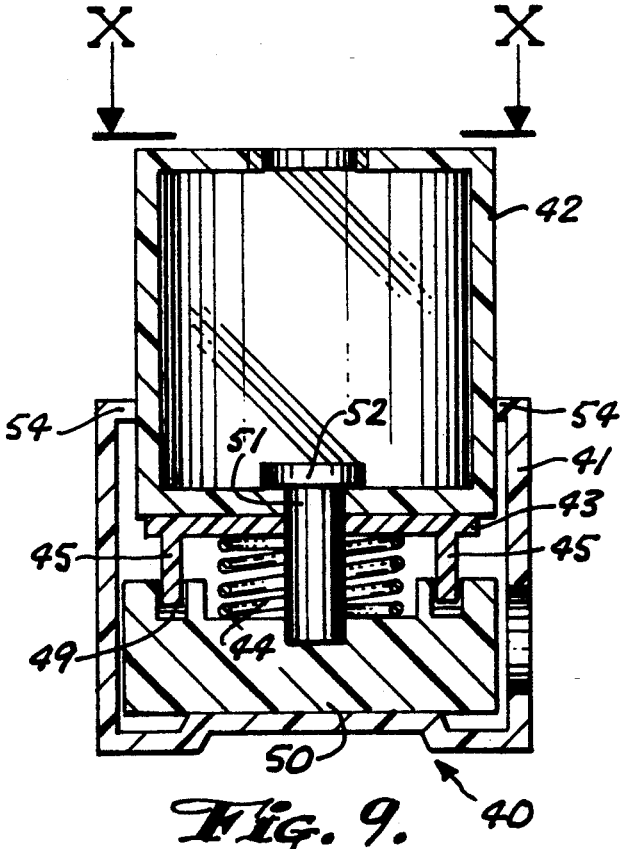
FIG. 9 is a section view of a spring loaded paper clip dispenser having a pressure sensitive switch to activate the sound producing device.
Figure 10:
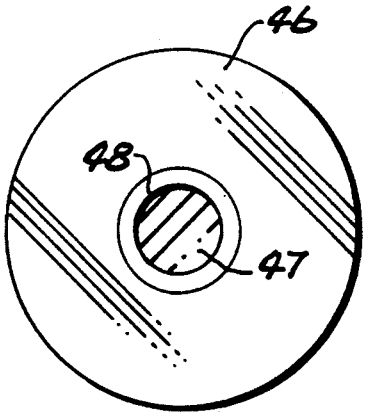
FIG. 10 is a top plan view of the dispensing cup along line X—X in FIG. 9.

In FIGS. 9 and 10, paper clip dispenser 40 has base 41 and container 42. Container 42 is seated, for example, on platform 43. Platform 43 is upwardly biased by spring 44 and has downwardly depending legs 45. Base 41 is open at its top and container 42 is seated at least slightly within the opening. A guide pin 51 is fixed to base 41. Container top 46 has aperture 47, preferably ringed by magnet 48 for magnetically securing magnetically attractable paper clips for convenient accessibility. A user, when reaching for a paper clip, exerts downward force on container top 46 which in turn forces platform 43 downward against the bias produced by spring 44. Downwardly depending legs 45 actuate switch button 49 thereby activating sound producing device 50. After cessation of pressure on container top 46, spring 44 returns platform 43 to its original position. Guide pin 51 preferably passes through an aperture in the bottom of container 42 for maintaining container 42 in an upright position. A removable cap 52 secures container 42 with base 41. Shoulders 54 defined by the top opening of base 41 provide further upright support for container 42.

Although particular embodiments of the invention have been shown and described, various forms and embodiments of the device are possible within the scope of the invention. For instance, as discussed, activation of the sound producing device can be achieved upon depression of a switch and deactivation by its release or vice versa. Various means for producing a closure or signal when the article is used are possible. Furthermore, one depression of the switch could activate the sound producing device with the next depression deactivating it. The base can be constructed of plastic, wood, etc., and other easily formable, inexpensive and durable materials are usable. When constructing the base of plastic, the base can be supplied in various colors to coordinate with the decor of the particular home or office. In view of these and other variations, which will now be apparent in view of this disclosure, reference should be made to the appended claims rather than the foregoing specification in assessing the scope of the invention in which exclusive rights are claimed.

What is claimed is:

1. A musical base for a desk top article, comprising:

a base having a bottom and an essentially flat upper surface for a placement of the article thereon;

a sound producing device in said base; and, switch means coupled to said sound producing device operable to activate said sound producing device, wherein the article is a desk-top note holder for sheets, said note holder having a substantially vertical hole defined by aligned holes in each of said sheets, said vertical hole defining a writing instrument holder, said note pad disposed on said base whereby said writing instrument holder aligns with said switch, said switch actuating upon a change in a content status of said writing instrument holder.

2. The musical base of claim 1 wherein said sound producing device is activated when a writing instrument occupies said writing instrument holder and deactivated when said writing instrument holder is vacant.

3. The musical base of claim 1 wherein said sound producing device is activated when said sound producing device is vacant and deactivated when said writing instrument holder is occupied.

4. The musical base of claim 1 further comprising timing means providing operation of said sound producing device for a controlled period after activation.

5. The musical base of claim 1 wherein the sound produced by said sound producing device includes at least one of music and speech.

6. A musical base sheet holder for writing sheets, comprising:

a base to be placed on a surface;

means defining a holder for the sheets disposed on the base;

a sound producing device in the base;

switch means coupled to the sound producing device, operable to activate the sound producing device when operated; and, wherein the musical base sheet holder includes a writing instrument holding means defining a receptacle for an elongated writing instrument, the receptacle being at least partly bounded by the base, and the switch means protruding from the base into the receptacle such that the switch means is operated upon one of insertion and removal of the writing instrument in the receptacle.

7. The musical base of claim 6 wherein the writing instrument holding means comprise a trough in said base for receipt of said writing instrument.

8. The musical base of claim 6 wherein said writing instrument holding means comprises a vertically disposed cylinder for receiving said writing instrument, and the switch is disposed at a bottom of the cylinder.

9. The musical base of claim 6 wherein said switch is a pressure sensitive switch, said switch having an actuating member located within said holding means.

10. The musical base of claim 6 wherein said switch is a photoelectric switch having a light sensor, said light sensor is mounted on a surface of said writing instrument holding means whereby insertion and removal of a writing instrument from said holding means changes a level of light striking said sensor for at least one of activating and de-activating said sound producing device.

11. The musical base of claim 6 wherein said switch is a photoelectric switch having a light sensor, said light sensor being mounted on a surface of said writing instrument holding means, whereby placement of a writing instrument in said holding means blocks lights from striking said sensor for at least one of activating and de-activating said sound producing device.

12. The musical base according to claim 6, wherein the receptacle is partly defined by the sheets.

13. The musical base according to claim 6, wherein the switch means comprises a contact element protruding into the receptacle.

14. The musical base according to claim 6, wherein the switch means comprises a light sensor having a beam path intersecting the receptacle.

15. The musical base of claim 6 wherein said sound producing device is activated when a writing instrument occupies said writing instrument holder and deactivated when said writing instrument holder is vacant.

16. The musical base of claim 6 wherein said sound producing device is activated when said sound producing device is vacant and deactivated when said writing instrument holder is occupied.

17. The musical base of claim 6 further comprising timing means providing operation of said sound producing device for a controlled period after activation.

18. The musical base of claim 6 wherein the sound produced by said sound producing device includes at least one of music and speech.

* * * * *